US005355603A

United States Patent [19]

Luikkonen

[11] Patent Number: 5,355,603

[45] Date of Patent: Oct. 18, 1994

[54] FASTENING SYSTEM FOR FASTENING BOARDS, PARTICULARLY ILLUMINATED ADVERTISING SIGNS

[75] Inventor: Jukka Luikkonen, Lappeenranta, Finland

[73] Assignee: Viismainos KY, Lappeenranta, Finland

[21] Appl. No.: 856,893

[22] PCT Filed: Nov. 28, 1990

[86] PCT No.: PCT/FI90/00288

§ 371 Date: May 14, 1992

§ 102(e) Date: May 14, 1992

[87] PCT Pub. No.: WO91/08562

PCT Pub. Date: Jun. 13, 1991

[30] Foreign Application Priority Data

Nov. 28, 1989 [FI] Finland ..... 895678

[51] Int. Cl.[5] ..... G09F 13/00

[52] U.S. Cl. ..... 40/541; 40/572; 40/575; 160/351; 403/388

[58] Field of Search ..... 40/541, 564, 571, 575, 40/576, 606, 607, 611, 572; 160/135, 351; 403/256, 260, 384, 388

[56] References Cited

U.S. PATENT DOCUMENTS 3,702,033 11/1972 Coleman ..... 40/541
3,713,237 1/1973 Thomson et al. ..... 40/575
3,984,931 10/1976 Belokin, Jr. ..... 40/559
4,276,706 7/1981 Scott ..... 40/607
4,436,135 3/1984 Ytter ..... 160/135

FOREIGN PATENT DOCUMENTS 864211 1/1953 Fed. Rep. of Germany ..... 40/611

*Primary Examiner*—Brian K. Green
*Attorney, Agent, or Firm*—Zarley, McKee, Thomte, Voorhees & Sease

[57] ABSTRACT

A fastening system which may be used for fastening boards, particularly illuminated advertising signs, by the opposite edge thereof to a frame structure. In the fastening system, the fastenable edge of a board are (15, 16) are fitted with a fastening profile (8) having a substantially H-shaped cross-section. The fastening system includes a cross-sectionally substantially C-shaped locking profile (9) as well as fastener (10) for fixing the C-profile (9) to a tubular member (2), included in the frame structure and cooperating with the C-profile. The fastening of board edges (15, 16) to a frame structure can be effected by placing a leg (9a) of C-profile (9) in a groove between the legs (8a) of H-profile (8) extending away from the board in a manner that the H-profile settles against the tubular member (2). Thereafter, upon fixing C-profile (9) to tubular member (2) with fastener (10), the H-profile (8) is locked through the action of friction between the leg (9a) of C-profile (9) and the tubular member (2).

6 Claims, 4 Drawing Sheets

FASTENING SYSTEM FOR FASTENING BOARDS, PARTICULARLY ILLUMINATED ADVERTISING SIGNS

BACKGROUND OF THE INVENTION

The present invention relates to a fastening system for fastening boards in general, and particularly to the application of a fastening system of the invention to fastening a certain type of an illuminated advertising sign. The invention further relates to an illuminated advertising sign element that can be fastened by means of a fastening system of the invention.

The invention relates to boards having a fastenable edge fitted with a fastening profile having a substantially H-shaped cross-section. An object of the invention is to provide a fastening system whereby the boards fitted with such H-profiles are fastenable in a relatively simple fashion to a frame structure and removable therefrom e.g. for repair, maintenance or like activities. Another object is to provide a fastening system whereby the angular position of boards to be fastened relative to the fastening point in a frame structure is adjustable whenever necessary.

DETAILED DESCRIPTION OF THE PREFERRED EMBODIMENT(S)

Figure 1:
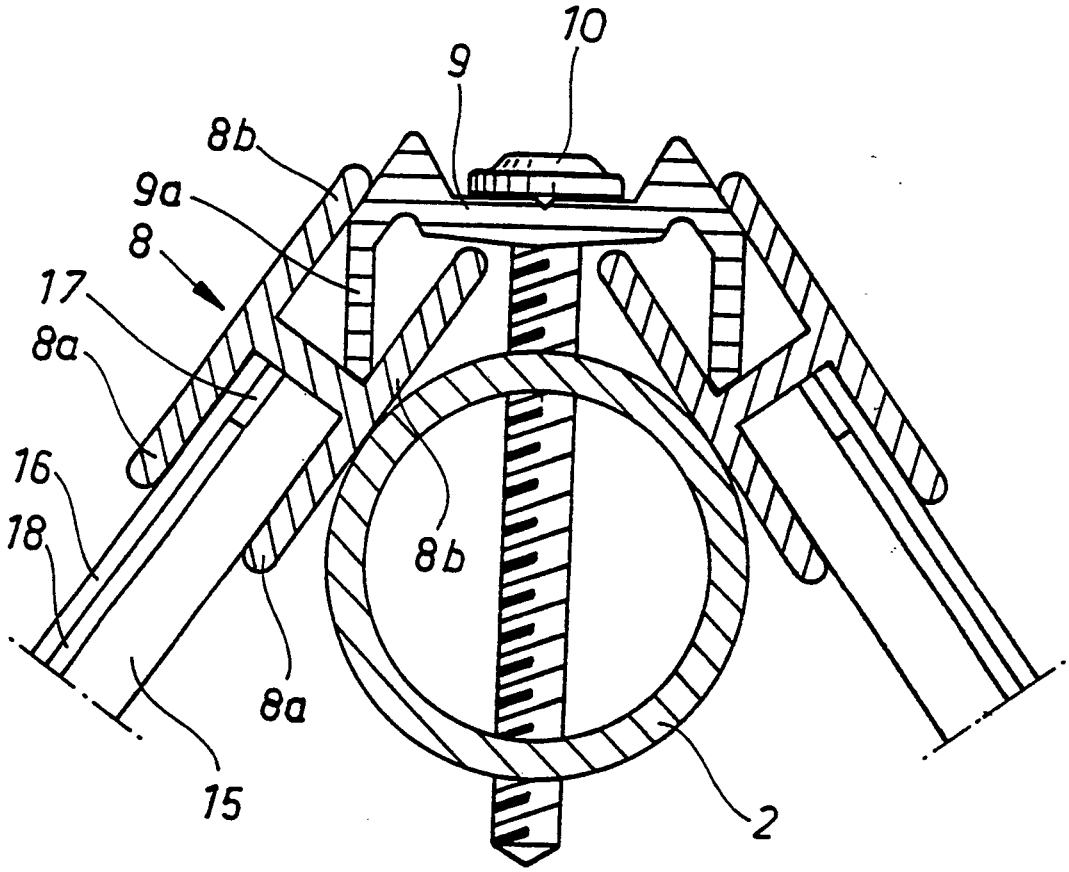
FIG. 1 shows a fastening system of the invention.

Referring to FIG. 1, a fastening system of the invention comprises a fastening profile 8, mounted on the edges of boards 15, 16 to be fastened and having a substantially H-shaped cross-section, as well as a locking profile 9 having a substantially C-shaped cross-section. A fastening system of the invention further comprises the use of a tubular member 2, which is a component of a frame structure and against which said H-profiles to be fastened are laid by means of a locking profile 9. According to FIG. 1, the fastening of boards 15, 16 is affected in a manner that in a groove between the legs 8*b* of H-profile 8 extending away from the board is positioned one leg 9*a* of C-profile 9, said C-profile being preferably pre-secured to tubular member 2 by means of fastening elements 10, such as screws, in a manner that said positioning of leg 9*a* in said groove is possible. This is followed by locking C-profile 9 in position in a manner that H-profile 8 is locked as a result of friction between said leg 9*a* of C-profile 9 and said frame component 2. In the case of FIG. 1, said tubular member 2 carries on either side thereof boards 15, 16 fitted with H-profiles 8. Naturally, this fastening system can be applied to fastening just a single board, whereby the other, free leg of C-profile 9 settles directly against tubular member 2. In a fastening system shown in FIG. 1, the angular position of H-profiles 8 of boards 15, 16 to be fastened relative to the plane defined by the opposite tubular members 2 can be changed by changing the relative dimensions of a groove between legs 8*b* of the H-profile and those of leg 9*a* of the C-profile. For example, by narrowing said groove the angular position can be decreased and by thinning said leg 9*a* the angular position can be increased. Preferably, the angular position is appr. 35° C. The tubular member 2 is preferably circular in cross-section, as shown in FIG. 1, but it can also in the shape of a pipe having any desired cross-sectional surface, such as for example in the shape of an ellipse or in the shape of a semi-circle or in the shape of a square pipe or some other curved-surface or polygonal pipe. The shape of a pipe is not essential in the invention but the size of a pipe must be selected in the embodiment of FIG. 1 in a manner that the contact point between said pipe and H-profile will be located within the area between the inner surface of leg 9*a* of C-profile 9 and the apex of the inner leg 8*a* of H-profile 8 facing towards pipe 2. When using a circular pipe, the diameter of pipe 2 must thus exceed the width between the inner surfaces of C-profile legs 9*a*. C-profile 9 could also be designed in a manner that the horizontal inner surface between its legs 9*a* is provided with a stop, the inner surface (the surface facing a groove between legs 8*b*) of the inner leg 8*b* of H-profile 8 resting against the inner surface of said stop, whereby said contact point must within the area between the inner surface of said stop and the inner surface of C-profile leg 9*a*. Thus, with a circular pipe, the diameter of pipe 2 must be smaller than the width between the inner surfaces of legs 9*a* but larger than the width between the inner surfaces of said stops. In this context, the inner surface of legs 9*a* and the stops refers to a surface which faces substantially towards the longitudinal medial plane between the legs 9*a* of C-profile 9. In the embodiment of FIG. 1, the fastening system is used for fastening an illuminated advertising sign 15, 16. This illuminated advertising sign comprises a translucent, cellular-structure base board 15 as well as a transparent, clear plastic sheet 16 laid thereupon. Between these there is provided a space 18 for an advertising poster or an advertising article, e.g. by means of an adhesive tape or a plastic strip or a like band 17 which is secured between boards 15, 16 to the edge portion thereof inside the legs 8*a* of H-profile 8.

Figure 2:
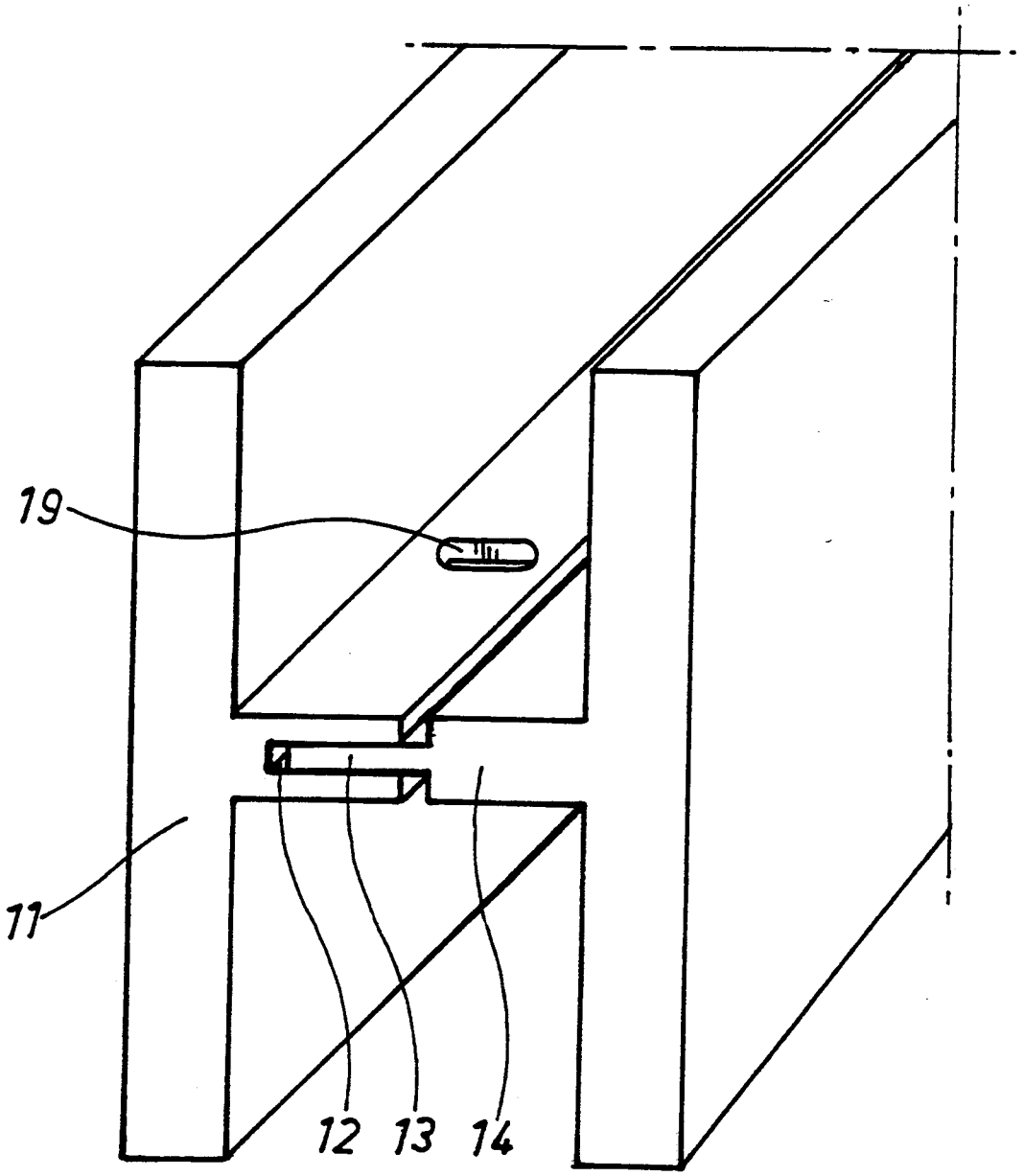
FIG. 2 shows a second embodiment of a fastening element for use in the fastening system of FIG. 1.

FIG. 2 illustrates another embodiment of a fastening profile 8 shown in FIG. 1. In this embodiment, the E-profile comprises two semi-profiles 11 and 14 that can be coupled together by means of a groove 12 extending lengthwise of the profile in first semi-profile 11 and by means of a matching, lengthwise protrusion 13 extending in second semi-profile 14 and insertable in groove 12. For locking said semi-profiles 11, 14 together, the first semi-profile 11 is preferably provided with an elongated aperture 19 which extends through semi-profile 11 and has its longitudinal axis running substantially crosswise relative to the longitudinal axis defined by groove 12. In addition, the protrusion 13 of second semi-profile 14 is accordingly provided with a throughgoing hole (not shown), which in the longitudinal direction of the semi-profiles can be set in alignment with said elongated hole 19, the relative position of semi-profiles 11, 14 being adjustable in the direction crosswise relative to the longitudinal axis within the limits defined by elongated hole 19.

This possible crosswise adjustment of semi-profiles 11, 14 facilitates the adjustment of the angular position of boards 15, 16 to be fastened as well as that of H-profiles 8 even when the material thicknesses of H-profile legs 8b and C-profile leg 9a are maintained constant. This adjustment of the angular position is necessary e.g. when it is desirable to alter the curvature of boards 15, 16 by changing the length of said boards. The C-profile is preferably made relatively rigid, e.g. by using a light metal, such as aluminium, as material. If necessary, the C-profile can also be made flexible e.g. by using a plastics material. In this case, the legs of a C-profile are made relatively rigid for keeping them in a fixed position in the groove of an H-profile when tightening the C-profile. On the other hand, the section between the legs is made flexible in a manner that, when the fastening means is tightened relative to the tubular member, said section between the legs bends into a convex shape towards the tubular member. Thus, the legs of a C-profile will spread outwards to give the H-profile a larger angular position. This profile design provides for a simple alternative adjustment of the angular position.

Figure 3:
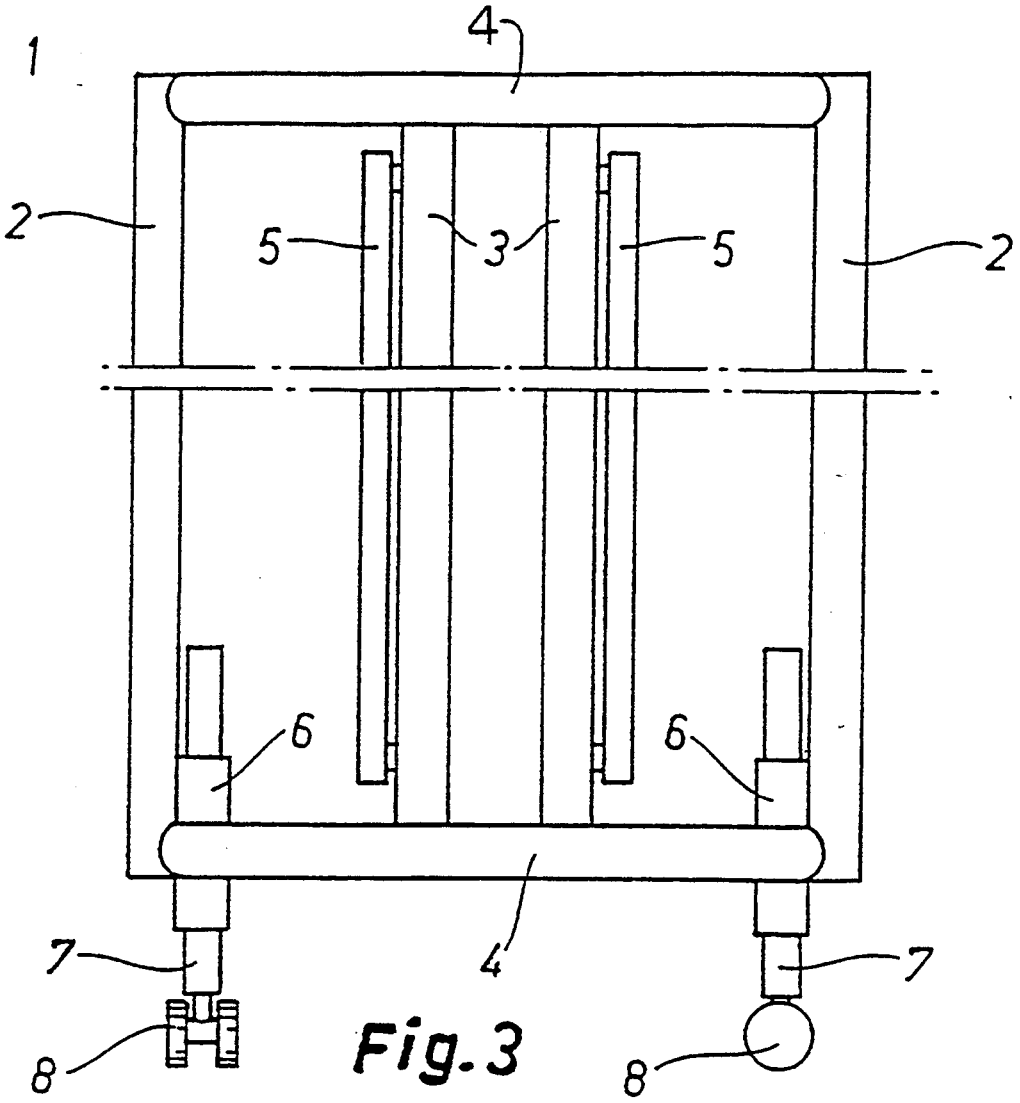
FIG. 3 shows a frame structure to which a fastening system of the invention is applicable.

FIG. 3 illustrates one possible frame design for the application of a fastening system shown in FIG. 1. A frame shown in FIG. 3 includes a frame 1, resting upon legs 7 and comprising two horizontal tubular members 4 and two vertical tubular members 2 fixed to the ends thereof. The frame further includes two intermediate support uprights 3 mounted in the space between said vertical side tubes 2. In the embodiment of FIG. 3, said vertical tubes 2 are made of tubular members having a circular cross-section, while said horizontal tubular members 4 as well as intermediate supports 3 are made of tubes having a square-shaped cross-section. Said tubular components are connected to each other-preferably by welding. In addition, the embodiment of FIG. 3 includes light sources 5, preferably fluorescent tubes, carried on intermediate supports 3. The vertical position of legs 7 relative to frame 1 is adjustable by means of a control tube 6, fixed to the lower horizontal tube 4 and having a square-shaped cross-section. In the illustrated embodiment, said leg 7 is further provided with wheels 8.

Figure 4:
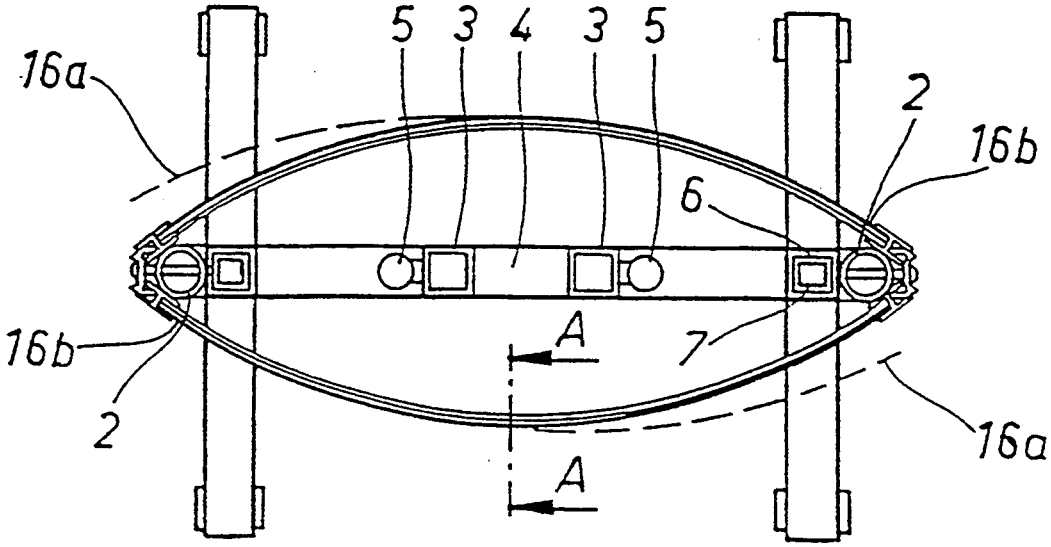
FIG. 4 shows the frame structure of FIG. 3 fitted with boards mounted by means of the fastening system of FIG. 1.
Figure 5:
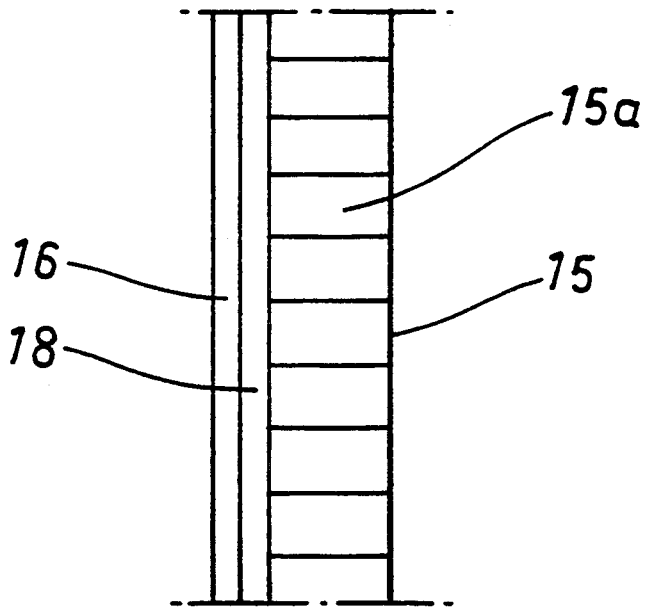
FIG. 5 shows a detail of a board element for use in the application of FIG. 4 in the direction of arrows A-A.

FIG. 4 illustrates the frame of FIG. 3 in a plan view with the upper horizontal tube 4 removed, said frame being provided with illuminated advertising elements mounted by means of a fastening system of FIG. 1. The illuminated advertising elements comprise two superimposed, light-transmitting flexible boards 15, 16, described above in connection with FIG. 1, the inner board 15 being made of a cellular sheet whose material is e.g. polypropylene. The outer board 16 is made of a transparent, clear plastic sheet, whose material e.g. PVC or polycarbonate. The edges of said boards 15, 16 are fitted with H-profiles 8 in a manner that, when the illuminated advertising sign element is in a horizontal position, the distance between its H-legs exceeds the distance between the fastening tubes 2 of frame 1. Thus, when H-profiles are secured to fastening tubes 2, the illuminated advertising element bends into an arched configuration. The cellular sheet 16 is permanently fixed by both of its opposite side edges to said H-profiles 8, e.g. by welding. On the other hand, the overlying board 16 is permanently secured by just one edge thereof while the other edge is fixed in a reopenable fashion in the groove between the legs 8a of the opposite H-profile 8. According to FIG. 4, the upper boards 16 in the illustrated two-way neon sign structure are positioned in a manner that the openable edge 16a of one of the elements is, together with the closeable edge 16b over on the opposite side, connected to the same tubular member 2 at any given time. The cellular sheet 15 is fastened to H-profiles 8 in a manner that the longitudinal axes of cells 15a in cellular sheet 15 lie in planes which are substantially parallel to each other and perpendicular to the longitudinal direction of H-profiles 8. Hence, as an illuminated advertising sign element 15, 16, together with its H-profiles 8, is mounted on frame 1, the longitudinal axes of cells 15a of cellular sheet 15 will become arched. According to FIGS. 3 and 4, said longitudinal axes of cells 15a are then further in a substantially perpendicular position relative to the longitudinal axis of fluorescent tubes 15 serving as light sources. Naturally, the leg-equipped illuminated advertising sign element frame shown in FIGS. 3 and 4 has several different applications.

First of all, according to FIG. 4, it can be used as a two-way element standing on its own legs. It can also be used e.g. in a manner that the illuminated advertising sign element on one side is removed and provided e.g. with a non-transparent cover plate. This type of one-way illuminated advertising sign element frame can also be used as a one-way wall-hanging element, whereby a cover plate is not necessary. Naturally, such illuminated advertising frames can also be mounted on top of each other by removing the legs 7 and wheels of an upper frame and by providing the top edge of a lower frame with suitable fasteners, e.g. square-shaped tubes, which fit in tube 6 for adjusting the vertical position of legs. In addition, the frame can be pivoted in a manner that the longitudinal axes of cells 15a in cellular sheet 15 become vertical, whereby the fastening profiles 8 as well as frame tubular members 2 and fluorescent tubes 5 settle in a horizontal position.

An essential feature is that, by disposing the longitudinal axes of fluorescent tubes 5 and cellular sheet to each other, it is possible to achieve a uniform diffusion of light.

The above exemplified embodiments are only intended to illustrate certain preferred applications of the invention and by no means to limit the scope of protection defined by following claims.

What is claimed is:

1. A combination of an illuminated advertising sign, a frame structure thereof and an arrangement for fastening the illuminated advertising sign by two opposite edges thereof to said frame structure, wherein the frame structure comprises a plurality of spaced apart tubular members, and wherein the illuminated advertising sign comprises a base sheet having two opposite edges one disposed at either end thereof and a transparent plastic sheet laid thereupon also having two opposite edges one disposed at either end thereof, said two opposite edges of said base sheet being at any given time permanently fitted within a pair of H-shaped profiles each having spaced apart legs defining a groove therebetween, in a manner that each of said opposite edges of said base sheet settles at any given time in the groove between the legs of a respective said H-shaped profile one of said opposite edges of said transparent plastic sheet being permanently fixed to one of said H-shaped profiles, the other edge of said plastic sheet being openably fixable in said groove of the other H-shaped profile, wherein between the transparent plastic sheet and base sheet is provided a space for an advertising poster, and wherein said illuminated advertising sign fitted with the H-shaped profiles is fixed to the frame structure in a manner that a distance along a straight line connecting said tubular members for catching said H-shaped profiles of said sign is smaller than a distance along a straight line connecting said H-shaped profiles when the H-Shaped profiles are caught by less than two of said tubular members whereby, when said illuminated advertising sign is caught by at least two of said tubular members of said frame structure, said illuminated advertising sign produces an arched light-transmitting advertising surface, and wherein the arrangement for fastening comprises a locking profile having a substantially C-shaped cross-section, fastening means for fastening the C-shaped locking profile to one of said tubular members included in the frame structure and cooperating with the C-shaped locking profile whereby the fastening of said advertising sign to the frame structure can be affected by placing a leg of said C-shaped locking profile in a groove between the legs of said H-shaped profile extending away from said advertising sign in a manner that the H-shaped profile settles against said tubular member whereby, upon fixing said C-shaped locking profile to said tubular member with said fastening means, said H-shaped profile is locked through the action of friction between the C-shaped locking profile and said tubular member.

2. The combination as set forth in claim 1 wherein said H-shaped profile comprises two semi-profiles (11, 14) provided with means (12, 13, 19) for adjusting the relative position thereof in a direction perpendicular to a longitudinal axis thereof, an angular position of a board (15, 16) to be fastened and that of said H-shaped profile (8) being adjustable relative to a plane defined by said spaced apart tubular members (2) by changing the relative position of said semi-profiles (11, 14)

3. The combination as set forth in claim 1 wherein said base sheet further comprises a cellular sheet (15) having a plurality of elongated cells, longitudinal axes of said cells (15*a*) of said cellular sheet (15) lie in planes substantially parallel to each other and substantially perpendicular to a longitudinal direction of said H-shaped profiles (8), whereby the longitudinal axes of the cells become arched in an operating position thereof.

4. The combination as set forth in claim 3 wherein the frame structure further includes legs (7) upon which is mounted a support frame (1) formed of said plurality of spaced apart tubular members, and said tubular members including two horizontal tubes (4) and two vertical (2) side tubes, said support frame (1) being further provided with two intermediate support uprights (3), said intermediate support uprights (3) being fitted with fluorescent tubes (5) serving as light sources, in a plane substantially perpendicular to the planes of the longitudinal axes of the cells (15*a*) of said cellular sheet (15) fixed to said side tubes (2).

5. The combination of claim 1, wherein said base sheet comprises a translucent cellular sheet.

6. The combination of claim 1 wherein each of said tubular members is a pipe of substantially circular cross section.

* * * * *